United States Patent [19]

Franzen

[11] 4,302,930

[45] Dec. 1, 1981

[54] SELF-THREADING YARN BRAKE MECHANISM

[75] Inventor: Gustav Franzen, Willich, Fed. Rep. of Germany

[73] Assignee: Palitex Project Company GmbH, Fed. Rep. of Germany

[21] Appl. No.: 123,118

[22] Filed: Feb. 21, 1980

[30] Foreign Application Priority Data

Feb. 22, 1979 [DE] Fed. Rep. of Germany ..... 2906811

[51] Int. Cl.[3] ..... D01H 13/10; D01H 15/00; D01H 7/86; B65H 59/14

[52] U.S. Cl. ..... 57/279; 57/58.86; 242/149

[58] Field of Search ..... 57/58.49, 58.86, 58.83, 57/279, 280; 242/147 R, 147 M, 149, 150 R, 150 M, 152.1

[56] References Cited

U.S. PATENT DOCUMENTS

| | | | |
|---|---|---|---|
| 2,029,943 | 2/1936 | Reiners et al. | 242/150 R |
| 2,253,521 | 8/1941 | Hitchcock | 242/150 R |
| 2,405,885 | 8/1946 | Gwaltney et al. | 242/149 |
| 2,590,372 | 3/1952 | Bley | 57/58.86 |
| 2,646,944 | 7/1953 | Heffelfinger | 242/150 R |
| 3,206,138 | 9/1965 | Lindsey | 242/150 R |
| 3,490,221 | 1/1970 | Heimes et al. | 57/58.86 |
| 3,945,184 | 3/1976 | Franzen | 57/58.86 |
| 3,975,893 | 8/1976 | Franzen | 57/279 |

FOREIGN PATENT DOCUMENTS

| | | |
|---|---|---|
| 180017 | 3/1954 | Austria . |

*Primary Examiner*—John Petrakes
*Attorney, Agent, or Firm*—Bell, Seltzer, Park & Gibson

[57] ABSTRACT

The improved yarn brake mechanism of this invention is provided with a tubular brake housing having axially spaced apart inlet and outlet openings for passage of a yarn therethrough and an enlarged cavity formed in the tubular brake housing between the inlet and outlet openings. A pair of cooperating brake platelets is mounted in the enlarged cavity of the brake housing, the brake platelets having surface portions positioned in opposing contacting relation for applying tension to a yarn passing therebetween, and having peripheral portions which cooperate with one another to form a V-shaped groove for guiding the yarn between the opposing contacting surface portions.

To insure that a yarn which is threaded through the brake housing will reach the V-shaped groove so as to become properly positioned between the opposing contacting surfaces of the brake platelets, a yarn passageway is provided extending within the cavity of the brake housing from the yarn inlet opening to the yarn outlet opening and past the pair of brake platelets. The passageway is so arranged as to extend alongside the periphery of the brake platelets with one wall of the yarn passageway comprising the peripheral portions of the brake platelets which form the V-shaped groove. The V-shaped groove is thus located for reliably guiding the yarn which is threaded through the elongate passageway between the brake platelets when tension is subsequently applied to the yarn.

9 Claims, 7 Drawing Figures

SELF-THREADING YARN BRAKE MECHANISM

FIELD OF THE INVENTION

This invention relates to a yarn brake mechanism for applying a desired tension or braking force to a yarn, and relates more particularly to an improvement in a yarn brake mechanism of the type having a pair of opposing contacting brake platelets for applying tension to a yarn passing therebetween.

BACKGROUND OF THE INVENTION

Yarn brakes of the so-called "platelet" type are known, as shown for example in Austrian Patent Specification No. 180,017 and German Patent Specification No. 968,222. In this type of yarn brake, two brake platelets are mounted with their opposing surfaces pressing against one another so as to apply a desired tension or braking force to a yarn passing between the brake platelets. Typically, either one or both of the brake platelets is mounted for movement within the brake housing, and the brake platelets are biased toward one another either magnetically or by means of springs.

In this type of brake mechanism, some provision must be made to insure that when the yarn is pneumatically threaded through the brake housing, the yarn will be properly positioned between the two opposing brake platelets. In some of the prior platelet-type brakes, a movable mechanical element has been provided for this purpose which is adapted to move one of the platelets away from the other to allow a yarn to be threaded therebetween. However, yarn brakes employing such movable mechanical elements are of relatively expensive design and are undesirable in that they require an additional working step to be carried out by the operator during a threading-up operation.

In the case of the yarn brake shown in the aforementioned German Patent Specification No. 968,222, two cooperating saucer-shaped brake platelets are mounted inside a relatively large opening or cavity in the brake housing. The edges of the two brake platelets are chamfered so that the two platelets form a V-shaped groove to allow the yarn to enter between the two platelets. However, because of the relatively large cavity provided in the brake housing, there is the possibility that when the yarn is threaded through the brake housing it will not reach the V-shaped groove so as to subsequently be brought in between the two brake platelets, but instead may bypass the two brake platelets and thus pass through the brake housing without any braking or tension force being applied to the yarn.

Similar problems with respect to the proper positioning of the yarn between the brake platelets following a threading operation are presented in the prior yarn brake arrangement shown in the aforementioned Austrian Patent Specification No. 180,017.

In another platelet-type yarn brake mechanism described in commonly assigned U.S. Pat. No. 3,945,184, one of the two cooperating braking members is formed as a part of the housing and comprises a generally flat inclined braking surface which surrounds the yarn passageway leading into the brake housing. A movable brake platelet is provided cooperating with the stationary braking surface for covering the yarn passageway and for thus applying tension to a yarn passing through the passageway and between the stationary braking surface and the movable brake platelet. A yarn bypass channel is formed in the brake housing leading from the yarn passageway and laterally alongside the stationary braking surface for receiving the yarn during the pneumatic threading of the yarn through the yarn passageway without the need for moving the movable brake platelet away from the stationary braking surface. When tension is subsequently applied to the yarn, as for example when the twisting spindle is restarted, the yarn is moved out of the bypass channel and into the proper position between the stationary braking surface and the movable brake platelet. Yarn brakes of this type have proven their worth in actual practice on many occasions. However, the specially shaped braking surface and yarn bypass channel which is required in this type of arrangement is relatively expensive to produce and undesirably increases the cost of the brake mechanism.

OBJECTS AND SUMMARY OF THE INVENTION

It is an object of the present invention to provide an improved yarn brake having a functionally reliable, yet simple arrangement for insuring that the yarn is properly positioned in the brake for application of a braking force thereto following threading of the yarn through the brake.

It is a further object of this invention to utilize in the improved yarn brake of this invention the so-called "platelet" type of braking elements which have proven their worth in practice in many applications.

These and other objects are achieved in the improved yarn brake of the present invention in which there is provided a tubular brake housing having axially spaced apart inlet and outlet openings for passage of a yarn therethrough and an enlarged cavity formed in the tubular brake housing between the inlet and outlet openings. A pair of cooperating brake platelets is mounted in the enlarged cavity of the brake housing, the brake platelets having surface portions positioned in opposing contacting relation for applying tension to a yarn passing therebetween, and having peripheral portions which cooperate with one another to form a V-shaped groove for guiding the yarn between the opposing contacting surface portions.

To insure that a yarn which is threaded through the brake housing will reach the V-shaped groove so as to become properly positioned between the opposing contacting surfaces of the brake platelets, an enclosed sided elongate yarn passageway is provided extending within the cavity of the brake housing from the yarn inlet opening to the yarn outlet opening thereof and past said pair of brake platelets. The yarn passageway is so arranged as to extend alongside the periphery of the brake platelets with one side of the yarn passageway comprising the peripheral portions of the brake platelets which form the V-shaped groove, and the remaining sides of the passageway being formed by the brake housing to define a lateral width for the passageway which is less than the width of the adjoining peripheral portions of the brake platelet. The V-shaped groove is thus located for reliably guiding a yarn which is threaded through the elongate passageway between the brake platelets when tension is subsequently applied to the yarn, as for example upon the restarting of the textile processing machine in which the yarn brake is located.

In accordance with one embodiment of the invention, the brake platelets are in the form of circular discs, and the enlarged cavity within the brake housing is of a generally cylindrical configuration of a diameter greater than the diameter of the disc-shaped brake platelets. The disc-shaped brake platelets are centrally mounted in the enlarged cylindrical cavity of the brake housing and cooperate therewith to form respective elongate yarn passageways extending peripherally along opposite sides of the disc-shaped brake platelets.

In another embodiment of the invention, the brake platelets are essentially in the form of leaf springs, each being mounted at one end, with the opposite ends of the leaf springs forming the aforementioned V-shaped groove. Means is provided for biasing the opposing contacting surfaces of the leaf springs toward one another so as to apply tension to a yarn passing therebetween. More particularly, the leaf springs are biased toward one another by a pair of compression springs, with one end of each compression spring engaging the outside surface of a respective one of said leaf springs, and with the yarn brake including respective support members positioned for engaging the opposite end of each compression spring. The support members are mounted for axial movement with respect to the brake housing and have an inclined surface which permits adjustment of the biasing force of the compression springs so as to thereby adjust the braking force applied to the yarn by the leaf springs. The two support members are preferably secured together at one end to form an essentially U-shaped yoke which permits simultaneous axial adjustment of the support members.

BRIEF DESCRIPTION OF THE DRAWINGS

Some of the objects and advantages of this invention having been stated, others will appear as the description proceeds when taken in conjunction with the accompanying drawings, in which.

DESCRIPTION OF ILLUSTRATED EMBODIMENTS

Yarn brakes in accordance with the present invention consist of compact tubular units which are suited for use in a diverse range of textile yarn processing machines. For purposes of illustration and for better understanding the invention, FIG. 1 of the drawings and the accompanying detailed description show how the yarn brake may be used in conjunction with the hollow twisting spindle of a two-for-one twister textile yarn processing machine, which is the preferred textile yarn processing machine utilizing the improved yarn brake mechanisms of this invention. However, it is to be understood that yarn brakes in accordance with the invention can also be used on other textile yarn processing machines where a yarn passes through a hollow housing and it is desired to apply a tension or braking force to the yarn.

Figure 1:
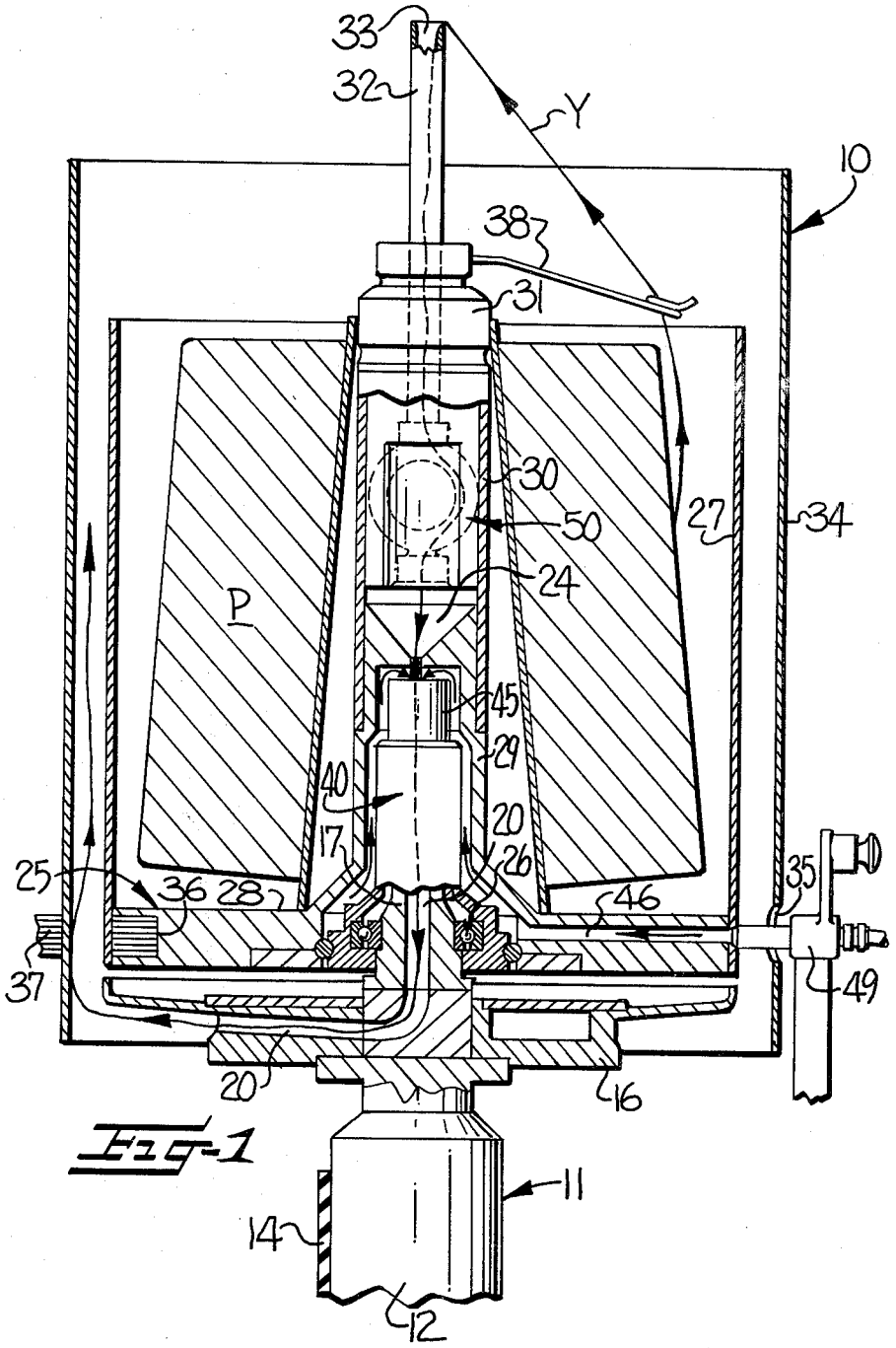
FIG. 1 is an enlarged cross-sectional elevational view of one spindle assembly station of a textile yarn processing machine utilizing the improved yarn brake mechanism of this invention.

Referring now to the drawings, there is illustrated in FIG. 1 a schematic cross-sectional view of a single spindle assembly station, generally indicated at 10, of a two-for-one twister textile yarn processing machine. It is to be understood that a plurality of these spindle assembly stations 10 are provided in side-by-side relationship in two rows along the outside of the machine. A full illustration and description of the entire two-for-one twister yarn processing machine is not given herein and is not believed to be necessary for an understanding of the present invention, the operation and complete structure of such a two-for-one twister being well understood by those with ordinary skill in the art.

Generally, each spindle assembly station 10 comprises a rotatably driven rotor mechanism, generally indicated at 11, which includes a whorl 12 suitably rotatably mounted on a portion of the twister frame (not shown) and rotated by a continuous tangential drive belt 14 in a manner well understood by those with ordinary skill in the art. The rotor mechanism 11 further includes a horizontally extending yarn reserve disc 16 secured to the whorl 12 for rotation therewith and a generally vertically extending hollow axle 17 which also rotates with the reserve disc 16. The reserve disc 16 and the hollow axle 17 define therewithin a generally L-shaped yarn passageway 20 extending generally vertically through the hollow axle 17 and a portion of the yarn reserve disc 16 and generally horizontally and radially out of the yarn reserve disc 16.

The spindle assembly 10 further includes a stationary carrier mechanism, generally indicated at 25, for supporting and carrying a hollow supply package P of yarn Y. The carrier mechanism 25 is mounted on the rotor mechanism 11 by bearings 26 so that the rotor mechanism 11 may rotate relative to the stationary carrier mechanism 25. The carrier mechanism 25 includes a basket device 27 which surrounds the package P, a circular bottom portion 28 for supporting the hollow yarn supply package P and a hollow tubular hub portion 29 extending upwardly into the hollow yarn supply package P for stabilizing the yarn supply package. A tubular housing 30 is carried by and extends upwardly from the upper end of the hub portion 29 and in which is contained the pneumatic yarn threading mechanism and the yarn brake mechanism, both to be described more fully hereinafter. A cap 31 is mounted at the upper end of the tubular housing 30 from which extends a hollow tubular yarn entry tube 32.

The yarn entry tube 32 has an axially extending passageway 33 for receiving and allowing passage of the yarn Y therethrough. As explained more fully hereinafter, the yarn brake mechanism and the associated yarn threading mechanism also have an axially extending yarn passageway 24 therethrough joining at the upper end with the passageway 33 of the yarn entry tube and at the lower end with the L-shaped passageway 20 of the rotor mechanism 11 to thus collectively provide a continuous yarn passageway (33, 24, 20) extending through the spindle assembly.

The spindle assembly 10 further includes a balloon limitor device 34 surrounding the basket 27 so as to contain a balloon of yarn Y formed around the outside of the basket 27. The balloon limitor 34 has an aperture 35 therein for purposes to be described below. In order to maintain the textile yarn package carrier mechanism 25 stationary during rotation of the rotor mechanism, there are provided magnets 36 carried by the bottom portion 28 and cooperating with magnets 37 carried by the balloon limitor device 34 to prevent rotation of the carrier mechanism 25.

The spindle assembly 10 further includes a flyer mechanism 38 mounted on the yarn entry tube 32 for free rotation about the axis of the spindle assembly. There is further provided a take-up mechanism (not shown) including a yarn take-up or package roll upon which the yarn Y is wound after being processed by the spindle assembly station 10. The take-up mechanism is conventional in a two-for-one twister yarn processing machine and an illustration thereof and further explanation is not believed necessary for a full understanding of this invention.

With the above-described mechanisms of the spindle assembly station 10, the yarn Y passes from the package P, through the rotating flyer mechanism 38, and into the yarn entry tube 32. The yarn then passes downwardly through the yarn passageways 33 and 24 of the carrier mechanism and through the passageway 20 of the rotor mechanism 11, emerging from the yarn reserve disc 16 in a generally horizontal direction. The yarn then passes upwardly between the basket 27 and the balloon limitor 34 and forms a rotating balloon of yarn which is contained by the balloon limitor 34. The yarn then passes upwardly to the take-up mechanism to complete its travel through the respective spindle assembly station 10. As is well understood by those with ordinary skill in the art, a two-for-one twist is inserted in the yarn Y during the above-noted path of travel.

To assist in threading the yarn Y from the package P through the respective passageways 33 and 24 of the carrier mechanism 25 and the passageway 20 of the rotor mechanism 11 during a periodic thread-up operation when the rotation of the rotor mechanism is stopped, the spindle assembly station 10 is provided with a pneumatically operated yarn threading mechanism, generally indicated at 40.

Figure 2:
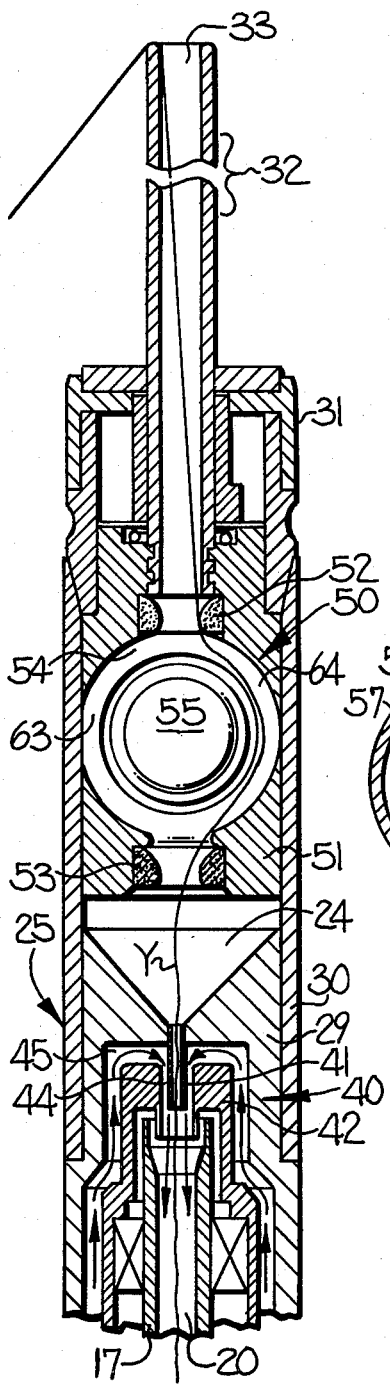
FIGS. 2 and 3 are axial sectional views of the spindle assembly of FIG. 1 showing the yarn brake mechanism of the present invention and the associated compressed air operated threading mechanism.
Figure 3:
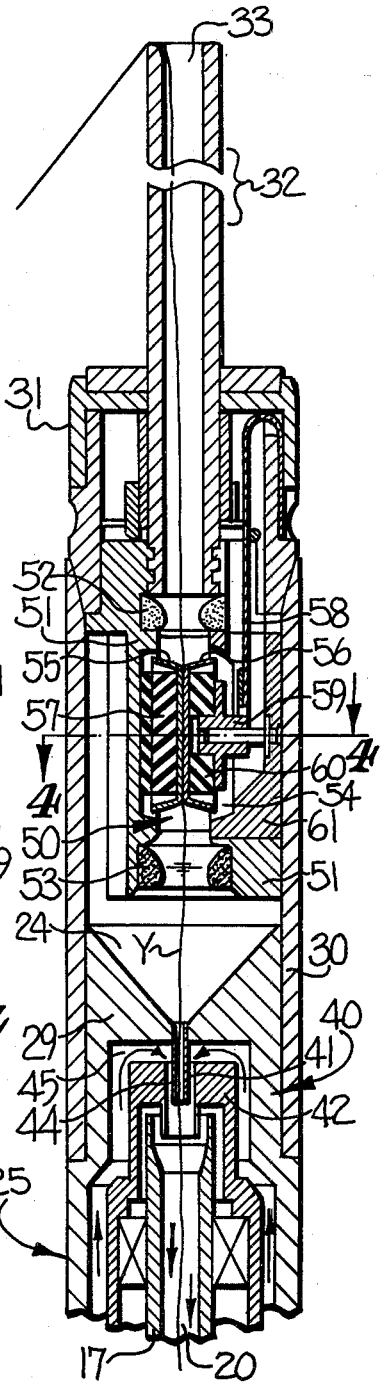

The yarn threading mechanism 40, more particularly, as seen for example in FIGS. 2 and 3, comprises an elongate hollow tubular air injector nozzle 41 which is mounted at the upper end of the hub portion 29 and forms a part of the yarn passageway 24. The air injector nozzle 41 extends downwardly into a hole formed in the upper end portion 42 of the carrier mechanism, and is located in spaced relation therefrom to form an annular gap 44 therebetween. The annular gap 44 is communicatively connected to an annular compressed air passageway 45 which extends upwardly within the hub portion 29 from the circular bottom portion 28 of the carrier mechanism. The passageway 45 communicates with a radially extending compressed air duct 46 provided within the circular bottom portion 28 of the carrier mechanism 25.

When compressed air is supplied to the compressed air duct 46 during a thread-up operation, this air passes through the compressed air passageway 45 and then downwardly through the annular gap 44 between the air injector nozzle 41 and the surrounding wall 42. This produces a suction air flow in the passageway 33 of the yarn entry tube and the passageway 24 extending through the upper portion of the spindle and the brake mechanism, and a positive air flow through the passageway 20 located therebelow. Thus, a yarn Y which is withdrawn from the package P and placed near the yarn entry tube 32 will be sucked through the passageway 33 and pneumatically threaded through the passageways 24 and 20.

Compressed air may be selectively supplied to the compressed air duct 46 of the carrier mechanism 25 during a thread-up operation by suitable means, as for example the arrangement shown in commonly owned U.S. Pat. No. 3,945,184 or U.S. Pat. No. 3,975,893. Thus, as shown by way of illustration in FIG. 1, compressed air may be selectively supplied by means of a selectively movable connector member 49 which is connected to a compressed air supply (not shown). The connector member is positioned for movement into and out of connecting engagement with the duct 46 formed in the carrier member 25.

Figure 4:
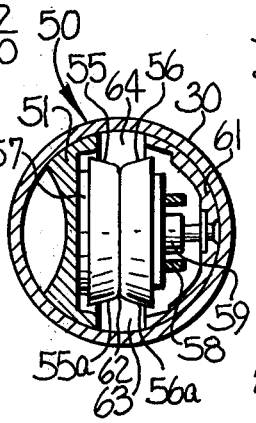
FIG. 4 is a horizontal sectional view through the spindle assembly, taken substantially along the line 4—4 of FIG. 3.

In accordance with the present invention, an improved yarn brake mechanism, generally indicated at 50, is positioned within the tubular housing 30 of the spindle assembly 10 for applying a desired tension to the yarn passing therethrough during processing of the yarn. In the first form of the invention, as illustrated in FIGS. 2–4, the yarn brake mechanism 50 includes an elongate hollow tubular brake housing 51 located within the tubular housing 30 at the upper end thereof. Adjacent the upper end of the housing 51 there is mounted a ring 52, formed of a wear-resistant material. Ring 52 adjoins the lower end of the yarn entry tube 32 and serves to define a yarn inlet opening in the hollow housing 51. A ring 53, similarly formed of a wear-resistant material, is mounted at the lower end of the tubular housing 51 and serves to define a yarn outlet opening for the housing 51. Between the rings 52 and 53, there is formed in the tubular brake housing 51 an enlarged cavity 54, of a flattened cylindrical configuration.

Two generally disc-shaped or saucer-shaped brake platelets 55, 56 are mounted within the enlarged cavity 54, with the surfaces of the platelets 55, 56 positioned in opposing, contacting relation with respect to one another and lying in a plane extending generally axially of the yarn inlet and outlet openings in the housing 51. As best seen in FIGS. 3 and 4, one of the brake platelets 55 has a mounting member 57 associated therewith which is secured to an adjacent portion of the brake houing 51 and which thus serves for mounting the brake platelet 55 in place within the enlarged cylindrical cavity 54. The other brake platelet 56 is held in place against the cooperating brake platelet 55 by a resilient mounting assembly, including a leaf spring 58, a cooperating circular mounting button 59 carried at the end of the leaf spring 58, and an annular shaped member 60 connected to the platelet 56 and into which the mounting button 59 is fitted. This mounting assembly serves to press the brake platelet 56 against the brake platelet 55 with a predetermined contact pressure. The brake housing 51 has a lateral aperture closed by an insert member 61, which aperture provides access for fitting the brake platelets 55, 56 and the leaf spring 58.

The disc or saucer-shaped brake platelets 55, 56 each have an upturned peripheral portion or flange (55*a*, 56*a* in FIG. 4) which cooperate with one another to form a generally V-shaped groove 62 along the circumferential periphery of the opposing contacting brake platelets 55, 56. The V-shaped groove 62 serves for receiving and guiding a yarn between the contacting surfaces of the platelets 55, 56 so that during operation of the braking mechanism the brake platelets can apply a braking force or tension to the yarn.

As best seen in FIG. 2, the brake platelets 55, 56 are of somewhat smaller diameter than the enlarged cylindrical cavity 54. There is thus formed between the cylindrical walls forming the cavity 54 and the peripheral portions 55*a*, 56*a* of the brake platelets 55, 56 a pair of relatively narrow semicircular yarn threading passageways 63, 64 extending from the yarn inlet opening to the yarn outlet opening of the brake housing and peripherally around the opposite sides of the pair of brake platelets.

When a yarn is pneumatically threaded through the spindle assembly by the pneumatic threading mechanism 40 in the manner previously described, the yarn must necessarily pass through one of the two yarn threading passageways 63, 64 without possibility of lateral deviation. When this yarn is subsequently tensioned upon the start-up of the spindle assembly, the tensioning of the yarn will cause it to be moved into the V-shaped groove 62 and then between the opposing surfaces of the brake platelets 55, 56. It will be appreciated that since the groove 62 essentially forms the inner arcuate side wall of the semicircular yarn threading passageways 63, 64 this arrangement insures reliable insertion of the yarn into the groove 62 and between the platelets 55, 56. There is no opportunity for the yarn to bypass the groove 62 and avoid becoming positioned between the brake platelets, since the distance or lateral extent between the edges of the peripheral portions 55*a*, 56*a* is greater than the lateral width of the adjoining passageways 63, 64.

Figure 5:
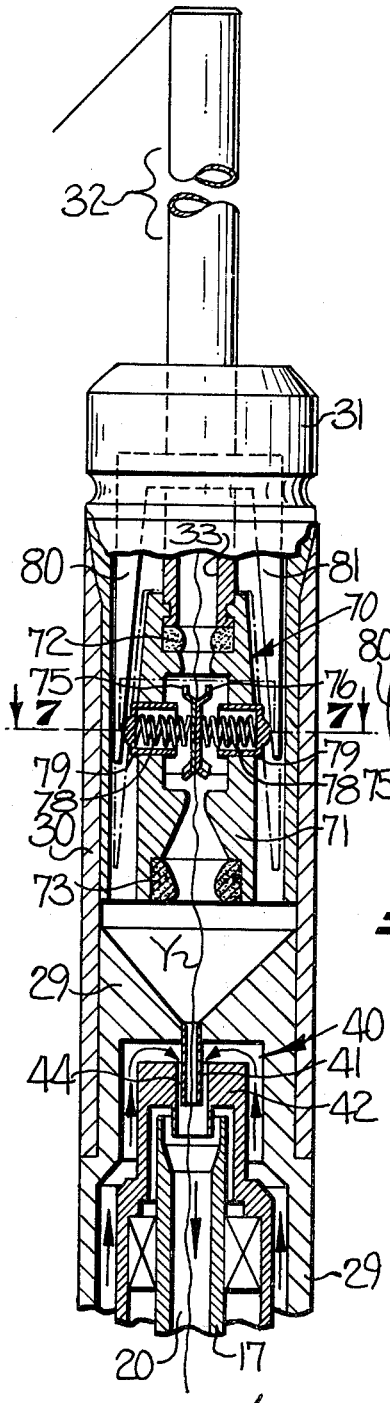
FIGS. 5 and 6 are axial sectional views of a spindle assembly showing an alternate embodiment of the yarn brake mechanism of the present invention and the associated compressed air operated threading mechanism.
Figure 7:
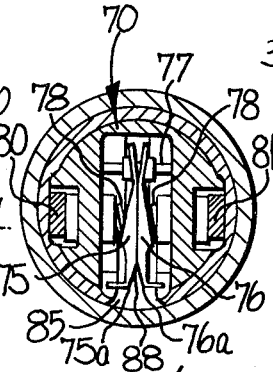
FIG. 7 is a horizontal sectional view through the spindle assembly taken substantially along the line 7—7 of FIG. 5.
Figure 6:
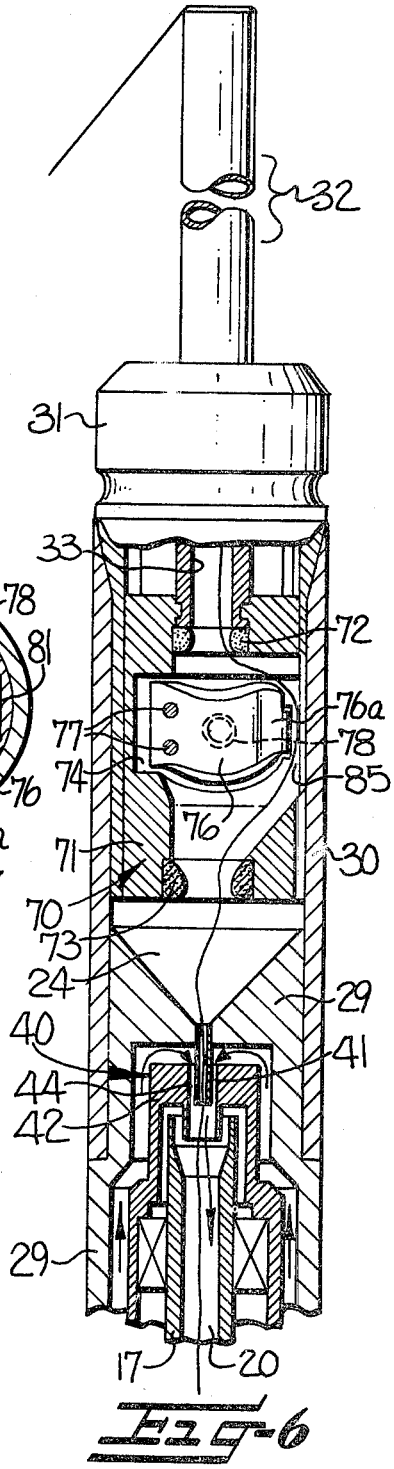

An alternate embodiment of a yarn brake mechanism in accordance with this invention is illustrated in FIGS. 5–7. As in the previous embodiment, the yarn brake mechanism is illustrated and described in conjunction with a hollow spindle assembly of a two-for-one twister textile yarn processing machine. To avoid repetitive description, the portions of the spindle assembly which have been previously described in conjunction with FIGS. 1–4 will bear the same reference characters wherever applicable.

In accordance with this embodiment of the invention, the yarn brake mechanism, generally indicated at 70, includes an elongate hollow tubular brake housing 71 which is similarly located within the tubular housing 30 of the spindle assembly at the upper end thereof. Adjacent the upper end of the housing 71 there is mounted a wear-resistant ring 72 which adjoins the lower end of the yarn entry tube 32 and serves to define a yarn inlet opening in the hollow housing 71. A wear-resistant ring 73 is mounted at the lower end of the tubular housing 72 and serves to define a yarn outlet opening for the housing 71. Between the rings 72, 73 there is formed in the tubular brake housing 71 an enlarged cavity 74 in which there is mounted a pair of opposing cooperating leaf springs 75, 76 forming a pair of brake platelets between the yarn inlet and outlet openings of the brake housing 71. The cooperating leaf springs 75, 76 are mounted to the brake housing at one end thereof by mounting pins 77. The free peripheral end portions 75*a*, 76*a* of leaf springs 75, 76 each have a slight bend therein formed so as to define a generally V-shaped groove 88 between the cooperating leaf springs 75, 76. Groove 88 serves for receiving and guiding a yarn between the opposing contacting surfaces of the leaf springs 75, 76.

Means is provided for biasing the opposing leaf springs 75, 76 toward one another so as to apply a braking force or tension to a yarn passing between the opposing contacting surfaces thereof. More particularly, the biasing of the leaf springs 75, 76 is accomplished by a pair of coil compression springs 78 mounted on opposite sides of the leaf springs. One end of each of these springs 78 engages the outside surface of an associated leaf spring, 75 or 76, while the opposite end of the coil spring 78 is positioned in a cup-shaped support 79 which, in turn, passes laterally through a hole provided in the brake housing 71. The outer ends of the support cups 79 which project outwardly through the housing 71 cooperate, for purposes of adjusting the brake force or the bias of the coil springs 78, with adjustable support members 80, 81. The support members 80, 81 each have an inclined or wedge-shaped face and are adjustable in the axial direction, as indicated by the dash-dot lines in FIG. 5. The upper ends of the wedge-shaped support members 80, 81 are joined together to form a generally U-shaped hook or yoke which is axially adjustable in one piece. The members 80, 81 may thus be adjustably positioned for varying the braking force or tension applied to the yarn passing through the yarn brake mechanism.

As best seen in FIG. 7, the free peripheral end portions 75*a*, 76*a* of the leaf springs 75, 76 which form the V-shaped groove 78 are spaced from the inner wall of the tubular housing 30 so as to provide a yarn threading pasageway 85 therebetween. It will thus be seen that when a yarn is threaded into the yarn inlet tube and is pneumatically drawn downwardly through the yarn inlet opening of the brake housing, it must pass into the yarn threading passageway 84 in its course of travel through the brake housing 71. As in the previous embodiment, the yarn passageway 85 is of an arcuate configuration and extends alongside the peripheral end portions 75*a*, 76*a* of the leaf springs, with the peripheral end portions 75*a*, 76*a* which form the V-shaped groove 88 comprising the inner arcuate side wall of the passageway 85. Thus, there is no opportunity for a yarn to bypass or avoid entering the groove 88, since the lateral width of the adjoining yarn threading passageway 85 is less than the width of the peripheral portions 75*a*, 76*a* which form the V-shaped groove 88. The yarn is thus positioned alongside the V-shaped groove 88, so that upon tensioning of the yarn, it is necessarily inserted between the opposing cooperating surfaces of the leaf spring brake platelets 75, 76.

In the drawings and specification there have been set forth preferred embodiments of the invention, and although specific terms are employed, they are used in a generic and descriptive sense only and not for purposes of limitation.

What is claimed is:

1. A yarn brake constructed for insuring reliable positioning of a yarn for application of a braking force thereto when the yarn is threaded through the brake, said yarn brake comprising a tubular brake housing having axially spaced apart inlet and outlet openings for passage of a yarn therethrough and an enlarged cavity formed in said tubular housing between said inlet and outlet openings, a pair of cooperating brake platelets mounted in said enlarged cavity, said brake platelets having surface portions positioned in opposing resiliently biased contacting relation for applying a braking force to a yarn passing therebetween, and said brake platelets having peripheral portions cooperating with one another to form a V-shaped groove for guiding the yarn between said opposing contacting surface portions, and said yarn brake having an enclosed sided elongate yarn passageway extending within said cavity from said inlet opening to said outlet opening and past said pair of brake platelets for threading of a yarn through said brake housing, one side of said elongate yarn passageway comprising said peripheral portions of said brake platelets which form said V-shaped groove and the remaining sides being formed by said brake housing to define a lateral width for said passageway less than the width of said peripheral portions whereby said V-shaped groove is positioned for receiving a yarn which is threaded through said passageway and reliably guiding the yarn between said brake platelets without the possibility of lateral deviation therefrom.

2. A yarn brake as set forth in claim 1 wherein said elongate yarn passageway is of an arcuate configuration and extends laterally around said pair of brake platelets, and said peripheral portions of said brake platelets which form said V-shaped groove comprise the inner arcuate side of said passageway.

3. A yarn brake as set forth in claim 1 wherein said contacting surface portions of said brake platelets lie in a plane extending generally axially of said yarn inlet and outlet openings in said brake housing, and wherein said peripheral portions of said brake platelets are laterally offset from the axis of said inlet and outlet openings.

4. A yarn brake as set forth in claim 1 wherein said brake platelets are in the form of circular discs, and said enlarged cavity is of a generally cylindrical configuration of a diameter greater than the diameter of said disc-shaped brake platelets, and wherein said disc-shaped brake platelets are centrally mounted in said enlarged cylindrical cavity and cooperate therewith to form respective elongate yarn passageways extending peripherally along opposite sides of the disc-shaped brake platelets.

5. A yarn brake as set forth in claim 1 wherein said brake platelets are essentially in the form of leaf springs, each mounted at one end to said brake housing, and the opposite ends thereof forming said V-shaped groove, and including means for biasing the opposing contacting surfaces of said leaf springs toward one another.

6. A yarn brake as set forth in claim 5 wherein said means for biasing said leaf springs comprises a pair of compression springs, one end of each compression spring engaging the outside surface of a respective one of said leaf springs, and including respective support members engaging the opposite end of each compression spring.

7. A yarn brake as set forth in claim 6 wherein each of said support members has an inclined surface and is mounted for axial movement with respect to said brake housing to thus permit adjustment of the biasing force of said compression springs for thereby adjusting the braking force applied to the yarn by said leaf springs.

8. A yarn brake as set forth in claim 7 wherein said support members are secured together at one end to form an essentially U-shaped yoke.

9. In a textile yarn processing machine, such as a two-for-one twister or the like, having a plurality of spindle assemblies, each having an elongate yarn passageway extending therethrough and including a pneumatic threading mechanism for automatically threading a yarn through said yarn passageway during a thread-up operation, the combination therewith of an improved yarn brake as set forth in any one of claims 1, 4 or 5.

* * * * *